US009643435B2

(12) United States Patent
Hirose

(10) Patent No.: US 9,643,435 B2
(45) Date of Patent: May 9, 2017

(54) PRINTER

(71) Applicant: SATO HOLDINGS KABUSHIKI KAISHA, Tokyo (JP)

(72) Inventor: Kenji Hirose, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/124,895

(22) PCT Filed: Apr. 8, 2015

(86) PCT No.: PCT/JP2015/060945

§ 371 (c)(1),
(2) Date: Sep. 9, 2016

(87) PCT Pub. No.: WO2015/166773

PCT Pub. Date: Nov. 5, 2015

(65) Prior Publication Data

US 2017/0021649 A1 Jan. 26, 2017

(30) Foreign Application Priority Data

Apr. 28, 2014 (JP) ..... 2014-092824

(51) Int. Cl.

| | |
|---|---|
| ***B41J 13/03*** | (2006.01) |
| ***B41J 3/407*** | (2006.01) |
| ***B41J 2/32*** | (2006.01) |

(52) U.S. Cl.

CPC ..... *B41J 13/03* (2013.01); *B41J 2/32* (2013.01); *B41J 3/4075* (2013.01)

(58) Field of Classification Search

CPC ..... B41J 13/0009; B41J 15/02; B41J 11/42; B41J 29/393; B41J 29/38; B41J 11/0045; B41J 2002/16573

See application file for complete search history.

(56) References Cited

U.S. PATENT DOCUMENTS 7,077,517 B2 * 7/2006 Awai ..... B41J 2/1752 347/104
8,702,329 B2 4/2014 Takabatake et al.
(Continued)

FOREIGN PATENT DOCUMENTS

JP 2001-232875 A 8/2001
JP 2002-019219 A 1/2002
(Continued)

OTHER PUBLICATIONS

Notification of Reasons for Refusal, JP 2014-092824, Jun. 9, 2015, 4 pages.

*Primary Examiner* — Lamson Nguyen
(74) *Attorney, Agent, or Firm* — Foley & Lardner LLP

(57) ABSTRACT

A plate spring is disposed at an outer lateral face of each of a pair of supporting members which a separation mechanism includes. In separation ejection, when an opening and closing cover is closed while pressing parts of an opening and closing cover is in contact with plate springs of the separation mechanism, the separation mechanism is fixed at the separation ejection position and the nip roller of the separation mechanism is biased toward the platen roller because of the effect of the plate springs. Since the plate springs can be pressed by the pressing parts of the opening and closing cover, a component to press the plate springs can be eliminated.

20 Claims, 14 Drawing Sheets

(56) References Cited

U.S. PATENT DOCUMENTS

| | | | | |
|---|---|---|---|---|
| 8,757,773 | B2 * | 6/2014 | Shinoda | B41J 2/155<br>347/42 |
| 2001/0016135 | A1 | 8/2001 | Hosomi | |

FOREIGN PATENT DOCUMENTS

| | | | |
|---|---|---|---|
| JP | 2004-358744 | A | 12/2004 |
| JP | 2006-150858 | A | 6/2006 |
| JP | 2010-222114 | A | 10/2010 |

* cited by examiner

PRINTER

TECHNICAL FIELD

The present invention relates to a label printer having a separation ejection function to separate a label with desired information printed thereon from a liner and eject the same.

BACKGROUND ART

Label printers are dedicated to label printing. In the label printing, one end in the longitudinal direction of a continuous label wound into a roll is pinched between a thermal head and a platen roller, and the continuous label is reeled off and fed in a sheet shape by rotating the platen roller. During this feeding, the thermal head prints desired information on each of a plurality of labels temporarily adhering to a long liner included in the continuous label.

There are two types of ejection schemes for such label printers, including normal ejection and separation ejection. The normal ejection is to eject labels while leaving the labels temporarily adhering to a liner, and the separation ejection is to separate labels from a liner and then eject the same.

In the case of the normal ejection, printing is performed continuously on a required number of labels while leaving the labels temporarily adhering to a liner, and then the labels can be separated from the liner at the site for attachment. This scheme is suitable for the case where a target for attachment of the labels is located in a place away from the printer.

Meanwhile in the case of the separation ejection, since the printer ejects labels separated from a liner one by one, this scheme is suitable for the case where a target for attachment of the labels is located near the operator. For the separation ejection, a separation unit attached to the printer is set at the separation ejection position, one end in the longitudinal direction of the liner is bent at a sharp angle via a separation pin, and then the one end is pinched between a nip roller of the separation unit and a platen roller. Thereby, when a continuous label is fed for printing by rotating the platen roller, the liner is fed while being pinched between the nip roller and the platen roller, and the printed labels are separated from the liner one by one and are ejected from the printer (see Laid open patent publication JP 2002-19219 A, for example).

SUMMARY OF THE INVENTION

Technical Problem

One of the printers studied by the present inventor includes a coil spring at a small gap between a shaft pivotally supporting a nip roller of the separation unit and an eave covering the nip roller. The coil spring biases the nip roller toward the platen roller. This configuration, however, requires the eave to support the coil spring, and therefore has the problem of increase in the number of components of the printer.

In view of the technical background as described above, the present invention aims to provide a technique capable of reducing the number of components of a printer.

Solution to Problem

A printer according to one aspect of the present invention is configured to print on a print medium including a label temporarily adhering to a liner, and the printer comprises: a housing; an opening and closing cover that can be opened and closed relative to the housing; a feed roller disposed at the opening and closing cover, the feed roller configured to feed the print medium; a print head disposed so as to be adjacent to the feed roller when the opening and closing cover is closed, the print head configured to print on the print medium; and a separation mechanism disposed close to an ejection port side of the print medium to separate the label from the liner during separation ejection of the print medium, the separation mechanism including a nip roller adjacent to the feed roller during the separation ejection, and an elastic structure configured to come into contact with the opening and closing cover during the separation ejection so as to bias the nip roller toward the feed roller.

In the printer according to a second aspect of the present invention, the separation unit may be disposed so as to move between a position of the separation ejection and a position of normal ejection that is away from the position of the separation ejection.

In the printer according to a third aspect of the present invention, the printer may further comprise a pair of pressing parts disposed at the opening and closing cover, the pair of pressing parts configured to close the opening and closing cover so as to press against the separation mechanism during the separation ejection.

In the printer according to a fourth aspect of the present invention, when the opening and closing cover is closed during the separation ejection, the elastic structure may come into contact with the pair of pressing parts of the opening and closing cover so as to guide the opening and closing cover to the position of the separation ejection, and when the separation mechanism reaches the position of the separation position, the elastic structure may bias the nip roller toward the feed roller.

In the printer according to a fifth aspect of the present invention, the separation mechanism includes a pair of supporting parts, and the elastic structure may extend from one end part to the other end part of the pair of supporting parts so as to guide the opening and closing cover during closing of the opening and closing cover.

In the printer according to a sixth aspect of the present invention, the elastic structure may be disposed detachably.

In the printer according to a seventh aspect of the present invention, the elastic structure may include a plate spring.

Advantageous Effects

According to the first aspect of the present invention, the pressing parts of the opening and closing cover press the elastic structure, and so an eave is not required. Therefore, the number of components of the printer can be reduced.

According to the second aspect of the present invention, the pressing parts of the opening and closing cover can move along the plate elastic structure, and therefore the opening and closing cover can be opened and closed smoothly.

According to the third aspect of the present invention, the elastic structure can be easily replaced.

According to the fourth aspect of the present invention, the elastic structure can be simplified.

According to the fifth aspect of the present invention, the printer can support two types of ejection, including the separation ejection and the normal ejection.

DESCRIPTION OF EMBODIMENTS

Figure 1A:
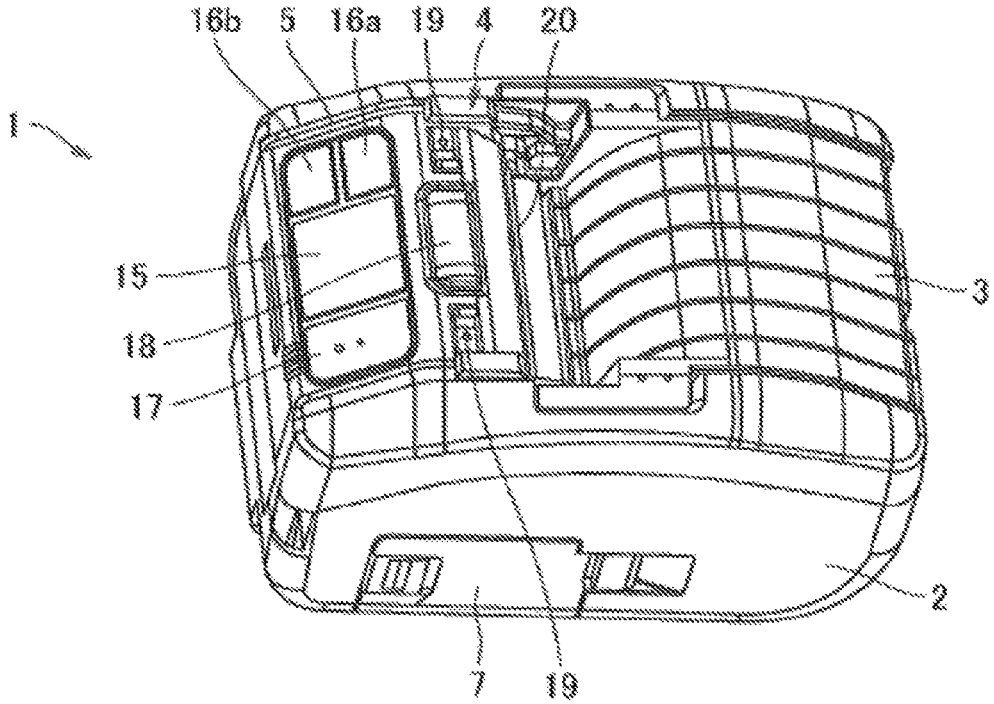
FIG. 1A is an overall perspective view of a printer according to the first embodiment in the normal ejection state.

The present invention relates to Japanese Patent Application No. 2014-092824, filed Apr. 28, 2014, the contents of which are incorporated herein by reference.

The following describes embodiments of the present invention as one example in details, with reference to the drawings. In the drawings to describe the embodiments, the same reference numerals are basically assigned to the corresponding elements, and the repeated descriptions thereon are omitted.

When continuous labels (labels with the liner) including a plurality of labels temporarily adhering to a long belt-like liner are used, the normal ejection is to eject the labels while leaving the labels adhering to the liner without separating the labels from the liner. The separation ejection is to separate the labels from the liner one by one and then eject the same. Meanwhile, when a continuous label (label without liner) having one face as an adhesive face is used or when a type of a label that does not temporarily adhere, such as a continuous sheet without an adhesive face, is used, the normal ejection is performed.

(First Embodiment)

Figure 1B:
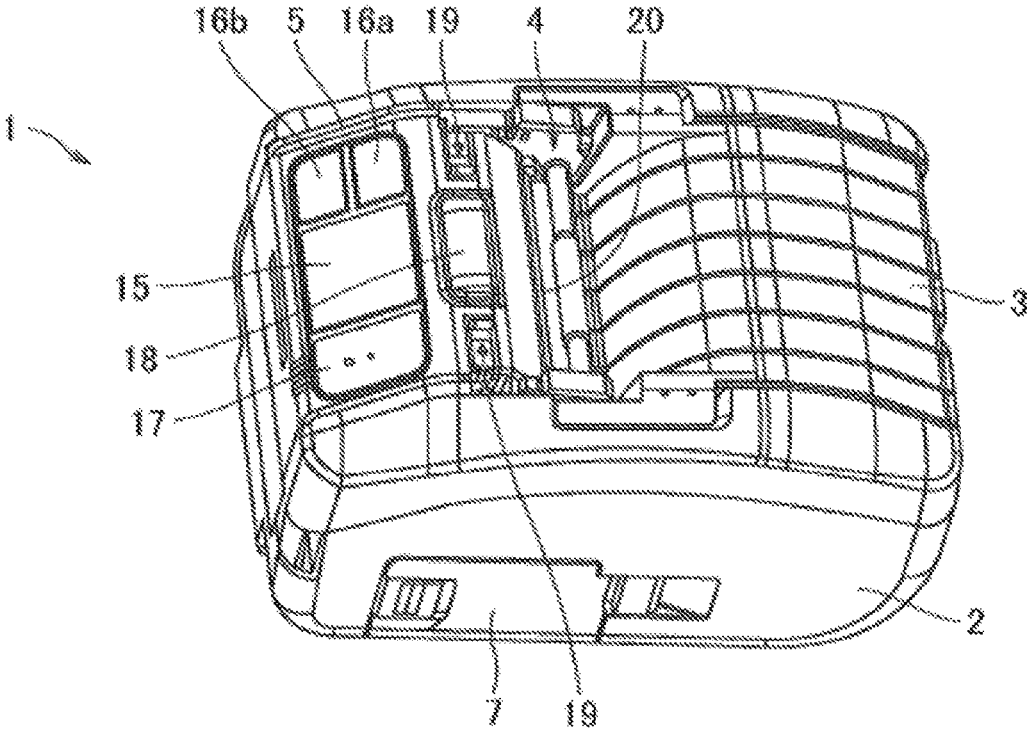
FIG. 1B is an overall perspective view of a printer according to the first embodiment in the separation ejection state.
Figure 2:
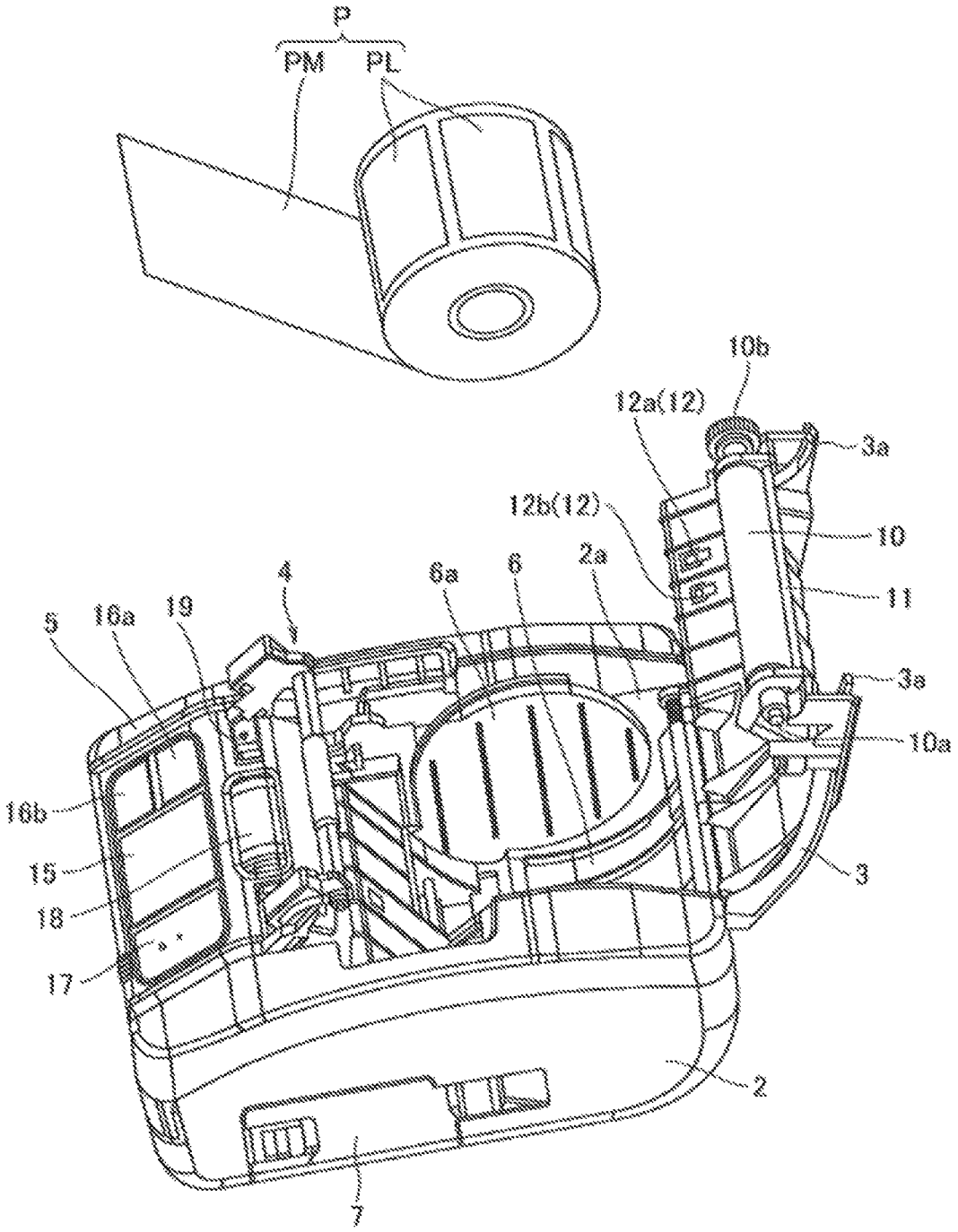
FIG. 2 is an overall perspective view showing the appearance of the printer of FIGS. 1A and 1B when the opening and closing cover is open, and the continuous label.
Figure 3:
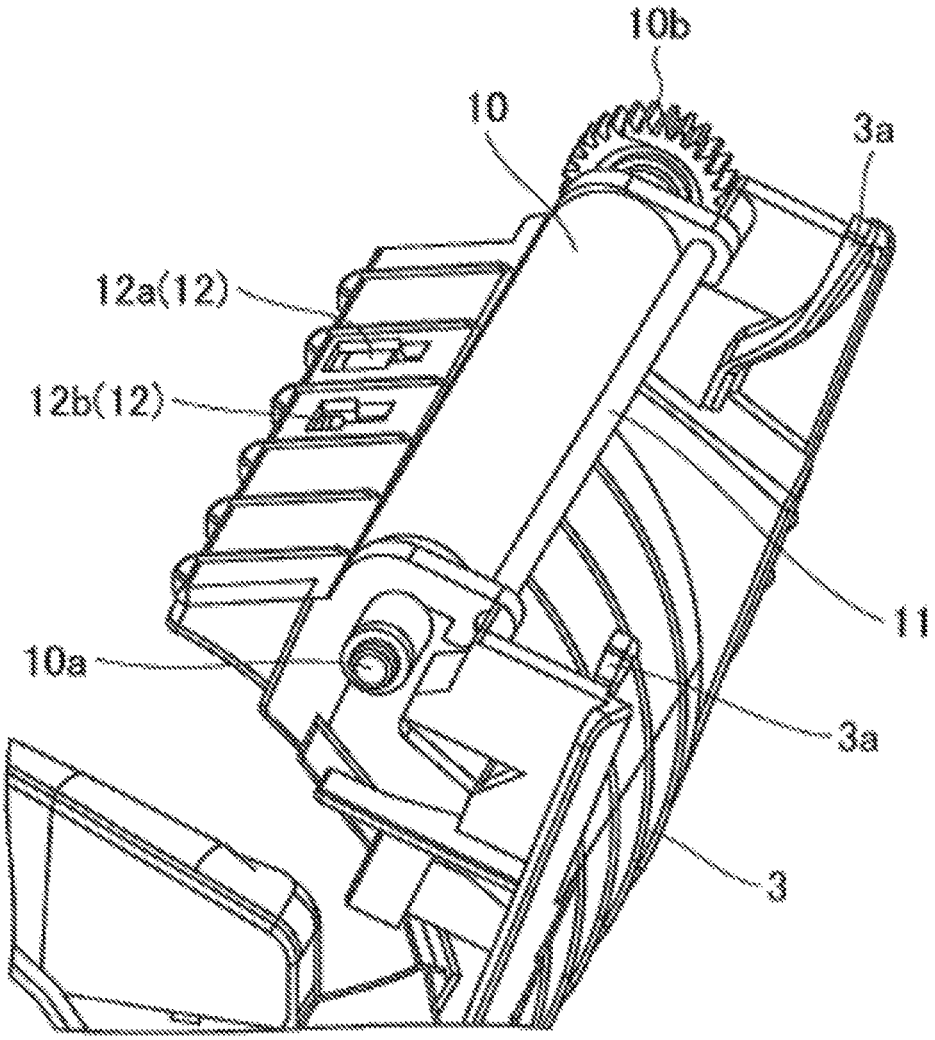
FIG. 3 is a perspective view showing the major part of the opening and closing cover of the printer of FIGS. 1A and 1B.

FIG. 1A is an overall perspective view of a printer according to the first embodiment in the normal ejection state. FIG. 1B is an overall perspective view of a printer according to the first embodiment in the separation ejection state. FIG. 2 is an overall perspective view showing the appearance of the printer of FIGS. 1A and 1B when the opening and closing cover is open, and the continuous label. FIG. 3 is a perspective view showing the major part of the opening and closing cover of the printer of FIGS. 1A and 1B.

As shown in FIGS. 1A and 1B, the printer 1 of the present embodiment is a portable label printer that has a flat cuboid shape, for example. The printer 1 includes a body case (one example of a housing) 2, an opening and closing cover 3, a separation unit (one example of a separation mechanism) 4 and a front cover 5. The printer is configured as a double-function type that can be switched between the normal ejection and the separation ejection. The printer 1 can be used with its ejection port directed upward (transverse posture), or can be used with a belt hook (not illustrated) on the bottom of the printer 1 hanging from a belt of the operator, or can be used with a shoulder belt (not illustrated) hanged on the shoulder of the operator so as to place the ejection port laterally (vertical posture).

The body case 2 is a housing that defines a part of the outer shape of the printer 1. On one face of the body case 2, an opening 2*a* is formed as shown in FIG. 2. In this opening 2*a*, a sheet container (one example of a print medium container) 6 is disposed. This sheet container 6 is a region in which a roll-shaped continuous label (one example of a print medium) P is contained. Inside of the sheet container 6, a sheet guide 6*a* is disposed. The sheet guide 6*a* is a member to rotatably support a roll-shaped continuous label P while coming into contact with both end faces of the roll-shaped continuous label P in the width direction, so as to guide the feeding of the continuous label P. The sheet guide 6*a* is movably disposed along the width direction of the continuous label P so as to change its position in accordance with the width of the continuous label P.

As shown in FIG. 2, the continuous label P has a long liner PM and a plurality of labels PL temporarily adhering to the liner along the longitudinal direction with predetermined intervals, for example. The continuous label P is wound into a roll and is contained in the sheet container 6. The label attaching face of the liner PM is coated with a parting agent such as silicone so as to facilitate the separation of the labels PL. On the rear face of the label attaching face of the liner PM, position detection marks (not illustrated) indicating the positions of the labels PL are formed with predetermined intervals along the longitudinal direction. On the surface (print surface) of each label PL, a thermo-sensitive colorproducing layer is formed that develops a specific color (e.g., black or red) when the temperature reaches a predetermined region.

As shown in FIGS. 1A to 2, a battery cover 7 is pivotally supported openably and closably on one lateral face of the body case 2. This battery cover 7 is an opening and closing cover of a battery container described later (not illustrated in FIGS. 1A to 3).

The opening and closing cover 3 is an opening and closing cover of the sheet container 6. In order that one end in the longitudinal direction (at a part closer to the center of the body case 2 in the longitudinal direction) of the opening and closing cover 3 can move away and closer to the body case 2, the other end in the longitudinal direction of the opening and closing cover 3 is pivotally supported at one end part in the longitudinal direction of the body case 2 via a hinge or the like. The opening and closing cover 3 is biased to the opening direction (the direction to which the one end in the longitudinal direction of the opening and closing cover 3 moves away from the body case 2) with a torsional spring (not illustrated in FIGS. 1A to 3) disposed close to the other end in the longitudinal direction.

As shown in FIGS. 2 and 3, a pair of pressing parts 3*a* is disposed at the one end in the longitudinal direction of the opening and closing cover 3. This pair of pressing parts 3*a* is a part to press against the separation unit 4 so as to fix the separation unit 4 at the separation ejection position when the opening and closing cover 3 is closed during the separation ejection. The pair of pressing parts 3*a* is disposed on both ends in the width direction (the direction orthogonal to the longitudinal direction of the opening and closing cover 3) of the opening and closing cover 3.

As shown in FIGS. 2 and 3, a platen roller (one example of a feed roller) 10 is pivotally supported at the one end in the longitudinal direction of the opening and closing cover 3 so that the roller can rotate in the forward direction and the reverse direction. This platen roller 10 is feed means to feed a continuous label P. The platen roller 10 extends in the width direction of the continuous label P. This platen roller 10 has a platen shaft 10*a*. A gear 10*b* is connected at one end of the platen shaft 10*a*. This gear 10*b* engages with a gear (not illustrated) or the like disposed in the opening 2*a* when the opening and closing cover 3 is closed, so that the gear 10*b* is mechanically connected to a stepping motor (not illustrated) for roller driving via such gear.

As shown in FIGS. 2 and 3, a separation pin 11 is disposed along the platen roller 10 at the one end in the longitudinal direction of the opening and closing cover 3 and in the vicinity of the platen roller 10. This separation pin 11 is a separation member to separate the labels PL from the liner PM. Both ends in the longitudinal direction of the separation pin 11 are pivotally supported at the opening and closing cover 3.

As shown in FIGS. 2 and 3, sensors 12 (12*a*, 12*b*) are disposed on a face of the opening and closing cover 3 at the one end in the longitudinal direction thereof. The face is opposed to a sheet-feeding route when the opening and closing cover 3 is closed. The sensor 12*a* is configured to detect the position of the labels PL (the position detection marks of the liner PM or a part of the liner PM between neighboring labels PL). The sensor 12*a* is a reflective optical sensor, or the like, for example. The sensor 12*b* is configured to detect the presence or absence of the continuous label P. The sensor 12*b* is a transmissive optical sensor, or the like, for example.

The separation unit 4 has a function to separate the labels PL from the liner PM during the separation ejection and to cause the feeding paths of the liner PM and the labels PL branch. The separation unit 4 is disposed so that one end in the longitudinal direction thereof is disposed movably between the normal ejection position inside of the printer 1 and the separation ejection position outside of the printer 1. The configuration of the separation unit 4 is described later in details.

As shown in FIGS. 1A to 2, the front cover 5 is fixed to the body case 2 so as to cover a part of the opening 2*a* of the body case 2 on the opposite side of the opening and closing cover 3 and parts near both of the lateral faces of the body case 2. A display unit 15, operation buttons 16*a*, 16*b*, a power-supply button 17, a cover-open button 18, a pair of release levers 19 and a cutter 20 are disposed on the front cover 5.

The display unit 15 is a screen to display a operation command, a message or the like. The display unit 15 is an LCD (Liquid Crystal Display), for example. The operation buttons 16*a*, 16*b* are configured to manipulate the operation of the printer 1. The power-supply button 17 is configured to turn the power supply of the printer 1 on or off.

The cover-open button 18 is configured to open the opening and closing cover 3. The release levers 19 are configured to hold the separation unit 4 at the normal ejection position. The held separation unit 4 can be released by moving these release levers 19 closer to each other.

The cutter 20 is configured to cut the liner PM of the continuous label P after the normal ejection. The cutter 20 is disposed at a front end part of the front cover 5 on the opposite side of the opening and closing cover 3. The cutter 20 extends along the width direction of the continuous label P. The ejection port is formed between the opening and closing cover 3 and the front cover 5.

Figure 4:
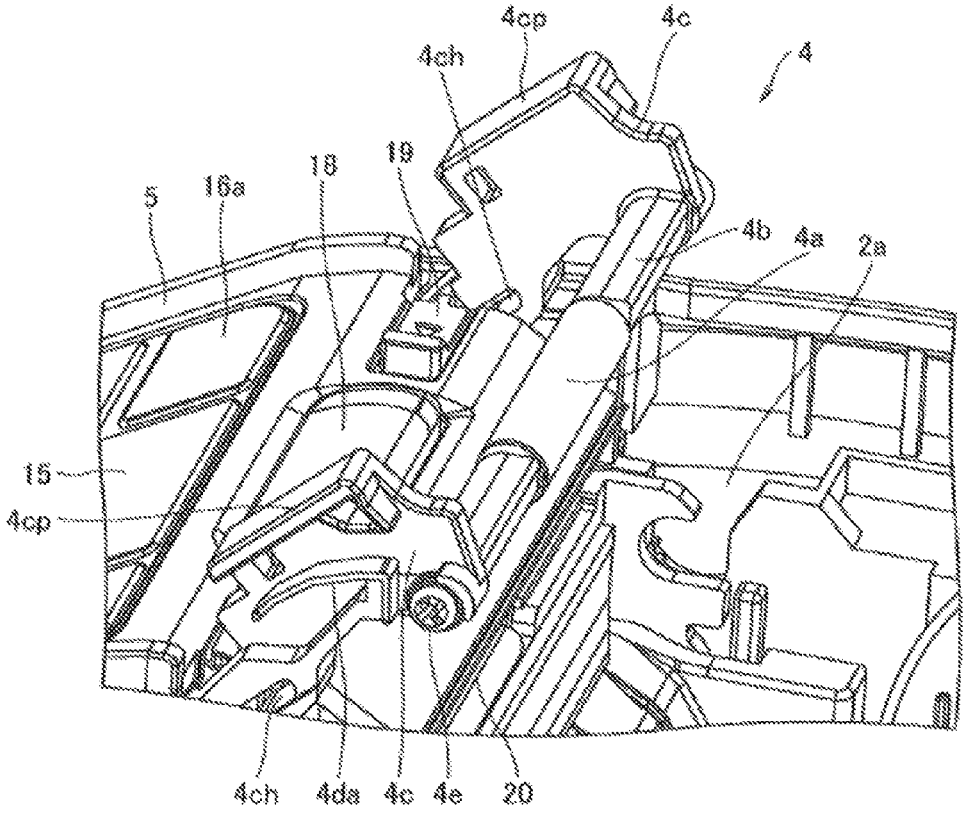
FIG. 4 is an enlarged perspective view of the separation unit of the printer in FIG. 2 and their surrounding major parts.
Figure 5:
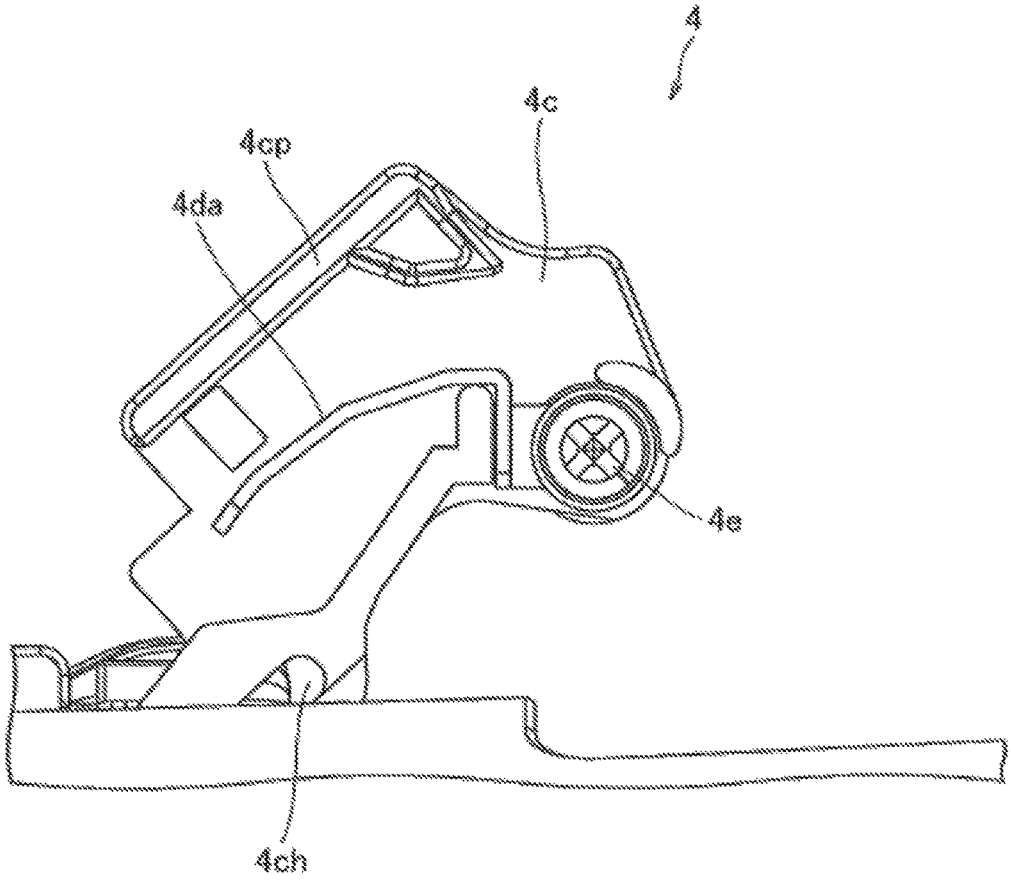
FIG. 5 is a lateral view showing the major part of the separation unit in FIG. 4.
Figure 6A:
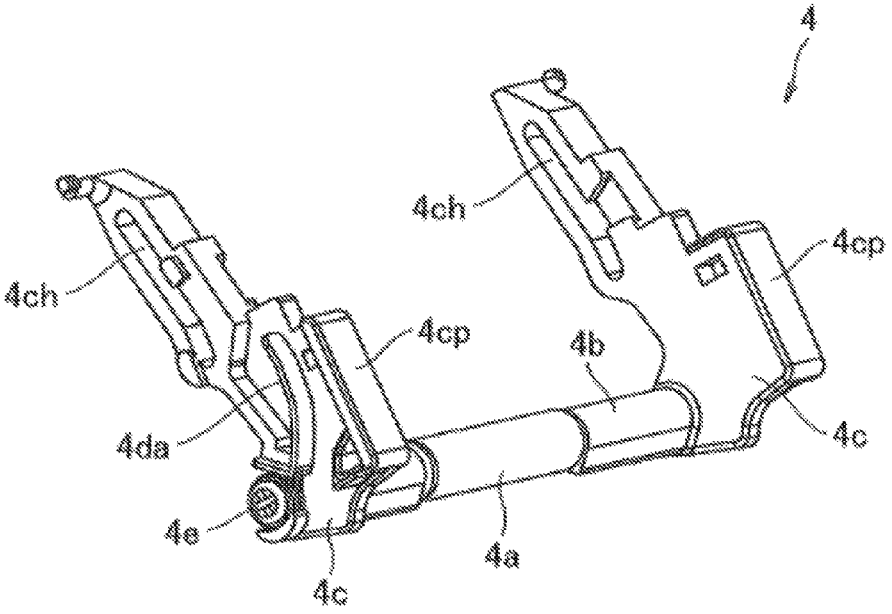
FIG. 6A is an overall perspective view showing the separation unit in FIG. 4 that is extracted.
Figure 6B:
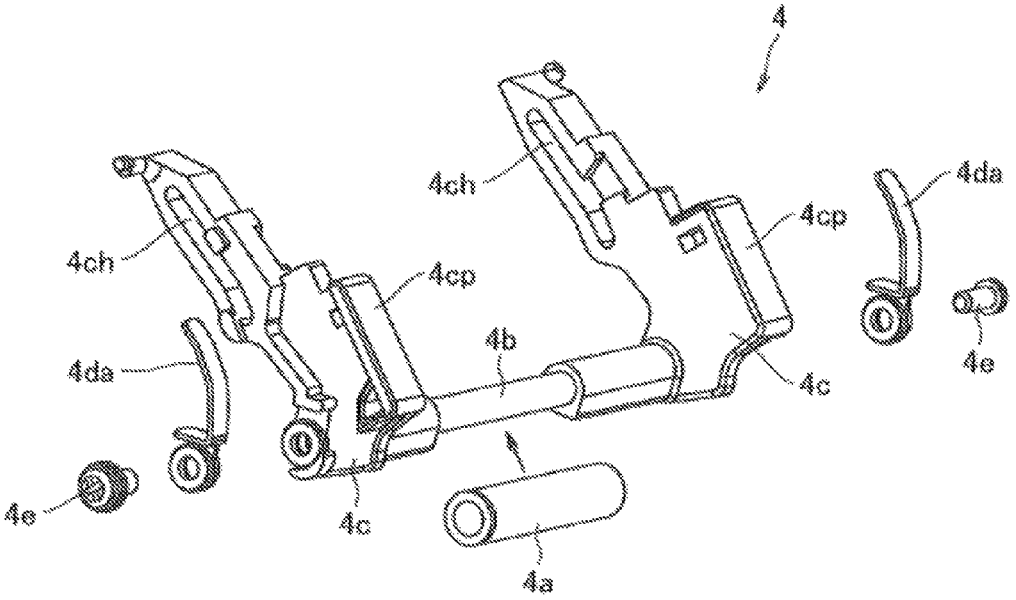
FIG. 6B is an exploded perspective view of the separation unit in FIG. 6A.

Next, the following describes the separation unit 4 with reference to FIGS. 4 to 6B. FIG. 4 is an enlarged perspective view of the separation unit of the printer in FIG. 2 and their surrounding major parts. FIG. 5 is a lateral view showing the major part of the separation unit in FIG. 4. FIG. 6A is an overall perspective view showing the separation unit in FIG. 4 that is extracted. FIG. 6B is an exploded perspective view of the separation unit in FIG. 6A.

The separation unit 4 includes a nip roller 4*a*, a shaft 4*b*, a pair of supporting parts 4*c*, a pair of plate springs (one example of an elastic structure) 4*da* and a screw 4*e*.

The nip roller 4*a* is disposed so as to be adjacent to the platen roller 10 during the separation ejection. The nip roller 4*a* is configured to pinch and feed the liner PM inserted between the nip roller 4*a* and the platen roller 10 with the platen roller 10.

This nip roller 4*a* is made of an elastic member such as rubber. The nip roller 4*a* is pivotally supported in a rotatable state at the shaft 4*b* that is sandwiched between one ends in the longitudinal direction of the pair of supporting parts 4*c*. The nip roller 4*a* has a length that is shorter than the overall length of the shaft 4*b*. The nip roller 4*a* is partly disposed at the center in the axial direction of the shaft 4*b*. Such a nip roller 4*a* is pressed toward the platen roller 10 via the continuous label P during the separation ejection, so as to rotate following the rotation of the platen roller 10.

The pair of supporting parts 4*c* is configured to support the nip roller 4*a* and the shaft 4*b*. An eave 4*cp* is formed at an upper part of one end side in the longitudinal direction of each supporting part 4*c* so as to extend outwardly from a lateral face of each supporting part 4*c*. As shown in FIGS. 6A and 6B, a guide rail hole 4*ch* is formed at the other end side in the longitudinal direction of each supporting part 4*c*. This guide rail hole 4*ch* is configured to guide and regulate the movement of the separation unit 4. The guide rail hole 4*ch* is formed like a long hole along the longitudinal direction of the supporting part 4*c*.

The pair of plate springs 4*da* is an elastic structure that comes into contact with the pressing parts 3*a* of the opening and closing cover 3 when the opening and closing cover 3 is closed during the separation ejection so as to bias the nip roller 4*a* toward the platen roller 10. In an outer lateral face of each supporting part 4*c*, each plate spring 4*da* is fixed at the one end side in the longitudinal direction of the supporting part 4*c* (the side on which the nip roller 4*a* is disposed), extends therefrom like a curve toward the other end side (the side on which the guide rail hole 4*ch* is disposed) in the longitudinal direction, and floats at the terminal end thereof.

One of the printers studied by the present inventor includes a coil spring at a small gap between a shaft pivotally supporting a nip roller of the separation unit and an eave covering the nip roller, so as to bias the nip roller toward the platen roller. This configuration, however, requires the eave to support the coil spring, and therefore the number of components increases. Further since the space to dispose the coil spring to bias the nip roller toward the platen roller is narrow, a small coil spring has to be used. Such a small coil spring leads to a problem of the small biasing force and the low durability. Such a small coil spring leads to another problem of being easy to lose during assembly of the printer.

On the contrary, in the present embodiment, the plate springs 4*da* are pressed by the pressing parts 3*a* that is a part of the opening and closing cover 3, and therefore an eave to support the coil spring in the above printers studied by the present inventor is not required. As a result, the number of components of the separation unit 4 can be reduced, and therefore the number of components of the printer 1 can be reduced.

Since the plate springs 4*da* are used as members to bias the nip roller 4*a* toward the platen roller 10, biasing force and durability thereof can be improved than in the case of a coil spring. Therefore, the life of the printer 1 can be improved.

Each plate spring 4*da* is disposed at a visible position on the outer lateral face of the supporting part 4*c*, and is fixed detachably with the screw 4*e*. Thereby, if each of the plate springs 4*da* is degraded, this can be replaced easily. Since the plate springs 4*da* are larger than the coil spring, it can prevent the loss during the replacement of the plate springs 4*da*.

The plate springs 4*da* are made of metal, for example. Therefore, biasing force and durability of the plate springs 4*da* can be further improved.

Since the plate springs 4*da* having a simple and single-body configuration are used, the printer 1 can be made compact and lightweight, and the cost of the printer 1 can be reduced.

Figure 7:
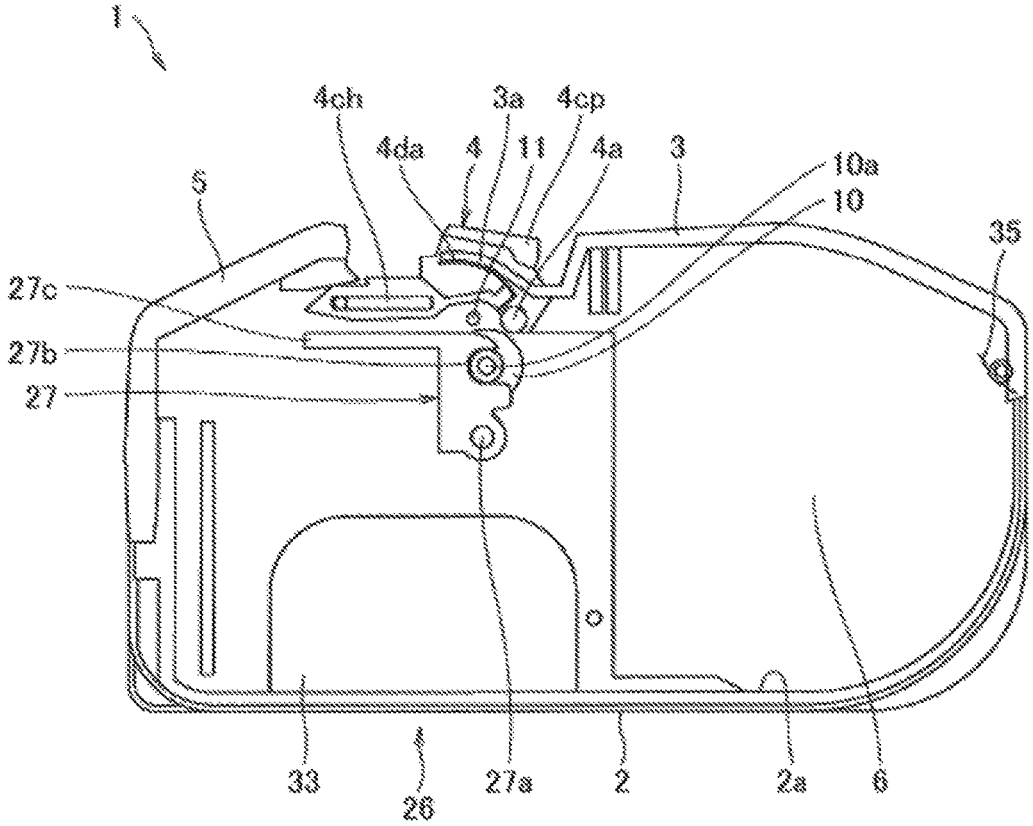
FIG. 7 schematically shows the configuration that is a view of the inside of the printer in the separation ejection state of FIGS. 1A and 1B from the lateral face.
Figure 8A:
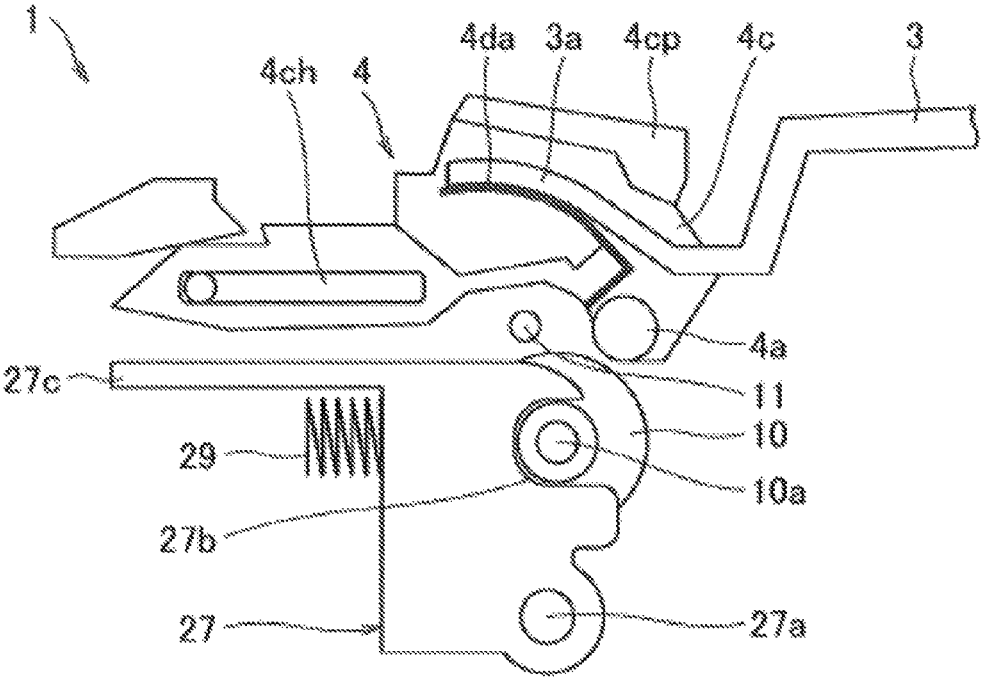
FIG. 8A is an enlarged schematic view of the major part of the printer of FIG. 7.
Figure 8B:
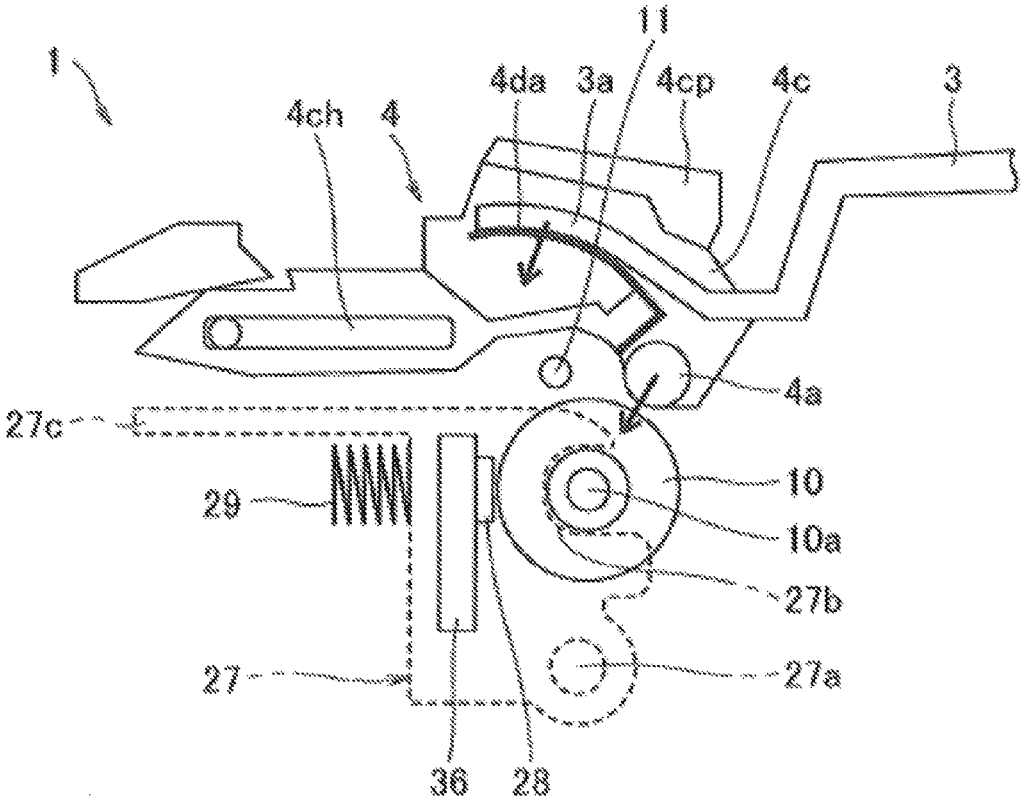
FIG. 8B is an enlarged schematic view of the major part of the printer of FIG. 7.

Next, the internal configuration of the printer 1 is described with reference to FIGS. 7 to 8B. FIG. 7 schematically shows the configuration that is a view of the inside of the printer in the separation ejection state of FIGS. 1A and 1B from the lateral face. FIGS. 8A and 8B are enlarged schematic views of the major part of the printer of FIG. 7.

As shown in FIG. 7, a main print part 26 is disposed adjacent to the sheet container 6 in the opening 2*a* of the body case 2. The main print part 26 is a functional unit to print on the labels PL of the continuous label P. The main print part 26 includes a head bracket 27, a thermal head (one example of a print head) 28 (see FIG. 8B), a coil spring 29 (see FIGS. 8A and 8B), the separation unit 4 and a battery container 33 (see FIG. 7).

The head bracket 27 is configured to hold the opening and closing cover 3 in the closed state. The head bracket 27 is disposed swingably about a rotating shaft 27*a* on the opposite side of the platen roller 10 when the opening and closing cover 3 is closed.

This head bracket 27 has a groove 27*b*. In this groove 27*b*, a platen shaft 10*a* of the platen roller 10 is fitted so that the head bracket 27 holds the opening and closing cover 3.

The head bracket 27 has a pressurization part 27*c* as well. This pressurization part 27*c* is disposed at a position (immediately below) adjacent to the cover-open button 18 shown in FIGS. 1A and 1B. When the cover-open button 18 is pressed, the pressurization part 27*c* also is pressed, so as to release the holding state of the opening and closing cover 3 by the head bracket 27. Then, when such a holding state of the opening and closing cover 3 is released, the opening and closing cover 3 will open automatically by the biasing force of the torsional spring 35 (see FIG. 7) disposed at the other end side in the longitudinal direction.

The thermal head 28 (see FIG. 8B) is print means to print information such as letters, symbols, graphics or barcodes on the labels PL. The thermal head 28 is mounted at the head bracket 27 via a circuit board 36 so that the thermal head 28 is adjacent to the platen roller 10 when the opening and closing cover 3 is closed and so that the print face of the thermal head 28 faces the sheet-feeding route. On the print face of the thermal head 28, a plurality of heater resistors (heater elements) that generate heat when applying current are arranged along the width direction of the continuous label P (the width direction of the liner PM). The circuit board 36 is a wiring board to transmit print signals to the thermal head 28.

The coil spring 29 (see FIGS. 8A and 8B) is configured to bias the head bracket 27 and the thermal head 28 toward the platen roller 10 when the opening and closing cover 3 is closed. The coil spring 29 is disposed on the rear side of the head bracket 27 (the rear face of the mounting face of the circuit board 36). Biasing force of this coil spring 29 presses the head bracket 27 toward the platen roller 10, and therefore the platen shaft 10*a* fitted into the groove 27*b* of the head bracket 27 also can be pressed firmly, so that the holding state of the opening and closing cover 3 by the head bracket 27 can be kept.

Herein in the present embodiment, as shown in FIG. 8B, the pressing part 3*a* of the opening and closing cover 3 is disposed at a gap between the eave 4*cp* and the plate springs 4*da* of the separation unit 4 during the separation ejection. The pressing part 3*a* comes into contact with the plate spring 4*da* for pressing so as to press against the separation unit 4. Thus, the separation unit 4 is fixed at the separation ejection position, and the nip roller 4*a* of the separation unit 4 is biased toward the platen roller 10. Therefore, the nip roller 4*a* of the separation unit 4 can be biased very stably toward the platen roller 10 during the separation ejection.

Figure 9A:
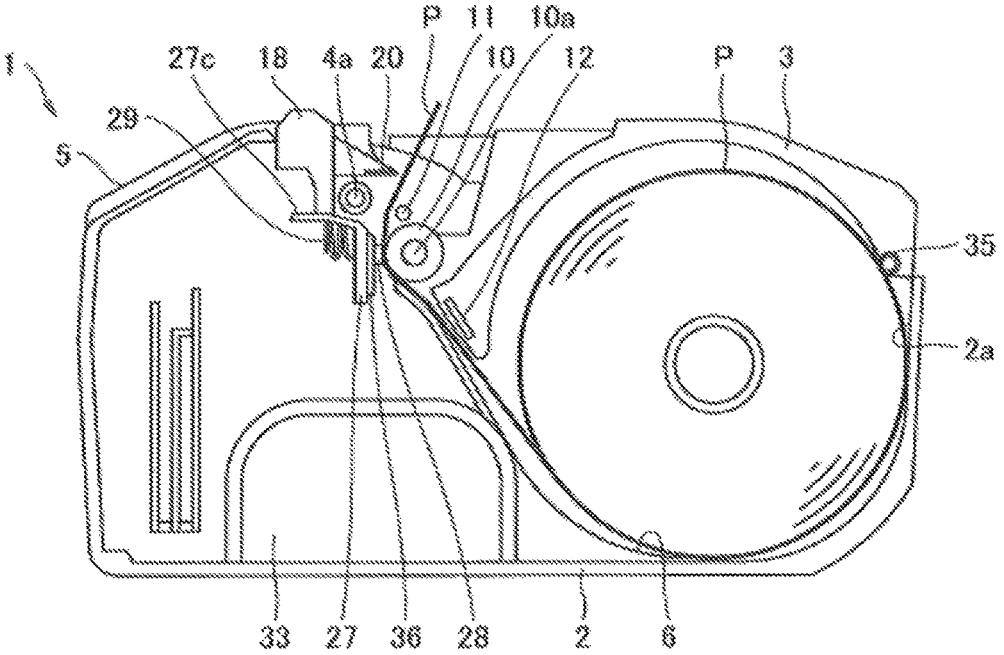
FIG. 9A schematically shows the configuration of the printer of FIG. 1A during normal ejection.
Figure 9B:
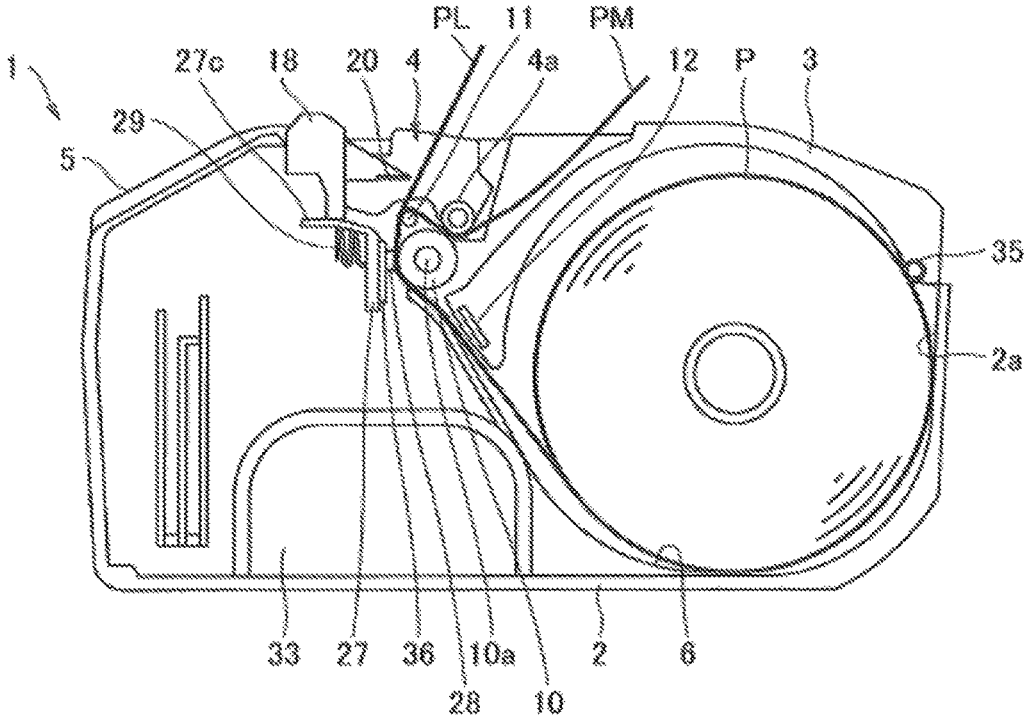
FIG. 9B schematically shows the configuration of the printer of FIG. 1B during separation ejection.

Next, the normal ejection and the separation ejection of the printer 1 are described with reference to FIGS. 9A and 9B. FIG. 9A schematically shows the configuration of the printer of FIG. 1A during normal ejection. FIG. 9B schematically shows the configuration of the printer of FIG. 1B during separation ejection.

In both of the normal ejection and the separation ejection, at the printing step, while the continuous label P reeled off from the sheet container 6 is pinched between the thermal head 28 and the platen roller 10, the platen roller 10 is rotated to feed the continuous label P. During this feeding, print timing is found based on the information detected by the sensors 12, and heat is selectively generated at the heater resistors of the thermal head 28 in accordance with the print signals transmitted to the thermal head 28, whereby desired information is printed on the labels PL of the continuous label P.

During the normal ejection, as shown in FIG. 9A, the separation unit 4 is disposed at the normal ejection position inside of the printer 1. The printed labels PL are ejected without being separated from the liner PM. In the case of the normal ejection, printing is performed continuously on the required number of labels PL while leaving the labels temporarily adhering to the liner PM. The printed labels PL can be separated from the liner PM at the site and be attached. Therefore, this scheme is suitable for the case where a target for attachment of the labels PL is away from the printer 1.

Meanwhile, during the separation ejection, as shown in FIG. 9B, the separation unit 4 is disposed at the separation ejection position and one end in the longitudinal direction of the liner PM is bent at a sharp angle via the separation pin 11, and is then pinched between the nip roller 4*a* of the separation unit 4 and the platen roller 10. Thereby, when the platen roller 10 is rotated to feed the continuous label P for printing, the liner PM is fed while being pinched between the nip roller 4*a* and the platen roller 10, whereas the printed labels PL are separated from the liner PM one by one, and each of the separated labels PL is ejected from the printer. In the case of the separation ejection, each of the labels PL separated from the liner PM is ejected in the one-by-one. Therefore, this scheme is suitable for the case where a target for attachment of the labels PL is located near the operator.

The printer 1 of the present embodiment can be switched between the normal ejection and the separation ejection, and so one printer can support two situations where the target for attachment of labels PL is located close to the printer 1 and away from the printer 1, which makes the printer 1 useful and economical.

In the printer 1 of the present embodiment, the effect of the plate springs 4*da* (see FIG. 8B) during the separation ejection enables the nip roller 4*a* of the separation unit 4 to be biased toward the platen roller 10 very stably so as to stably feed the liner PM and stably eject the labels PL. This means that printing on the labels PL can be stable so that a quality of information printed on the labels PL is improved.

Figure 10A:
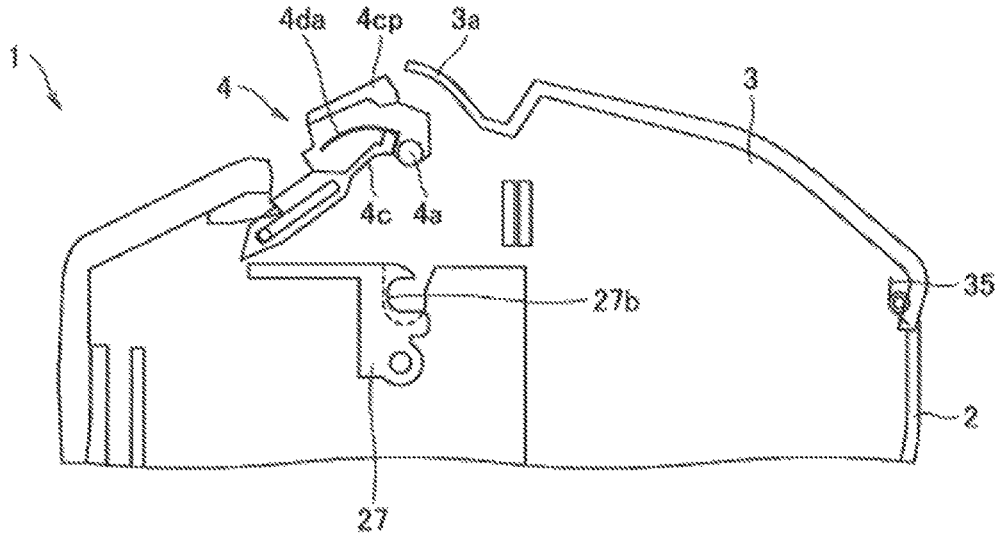
FIG. 10A schematically shows the configuration of the major part of the printer, showing the closing state of the opening and closing cover to set the separation unit at the separation ejection position.
Figure 10B:
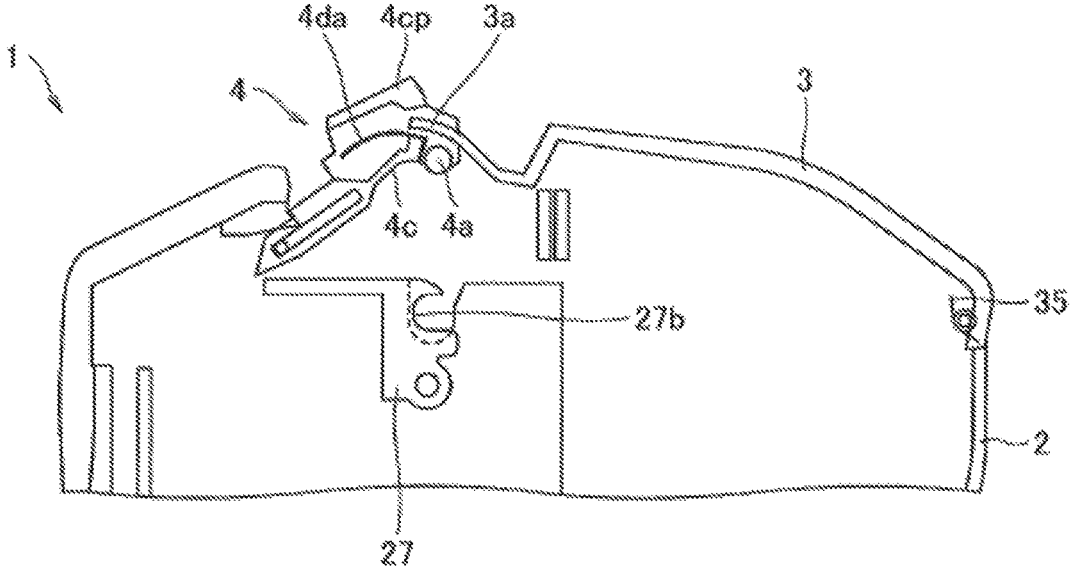
FIG. 10B schematically shows the configuration of the major part of the printer, showing the closing state of the opening and closing cover to set the separation unit at the separation ejection position.
Figure 11A:
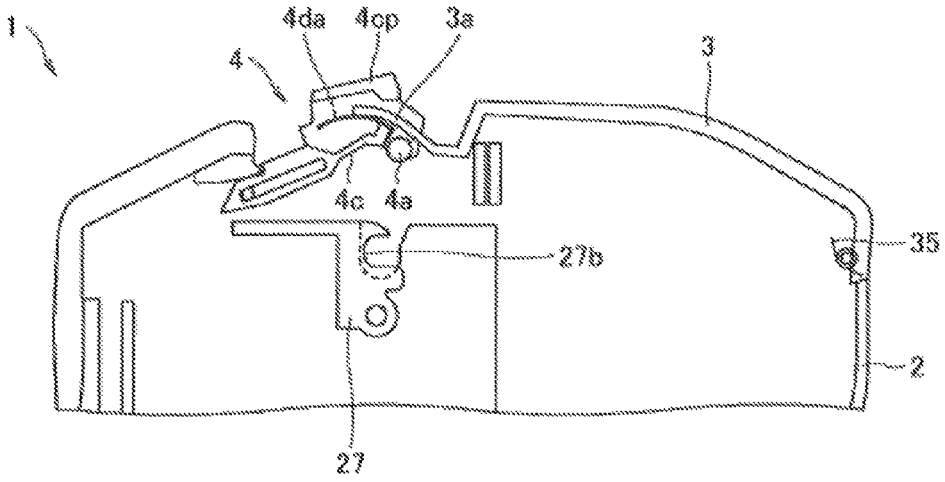
FIG. 11A schematically shows the configuration of the major part of the printer, showing the closing state of the opening and closing cover, following FIG. 10B to set the separation unit at the separation ejection position.
Figure 11B:
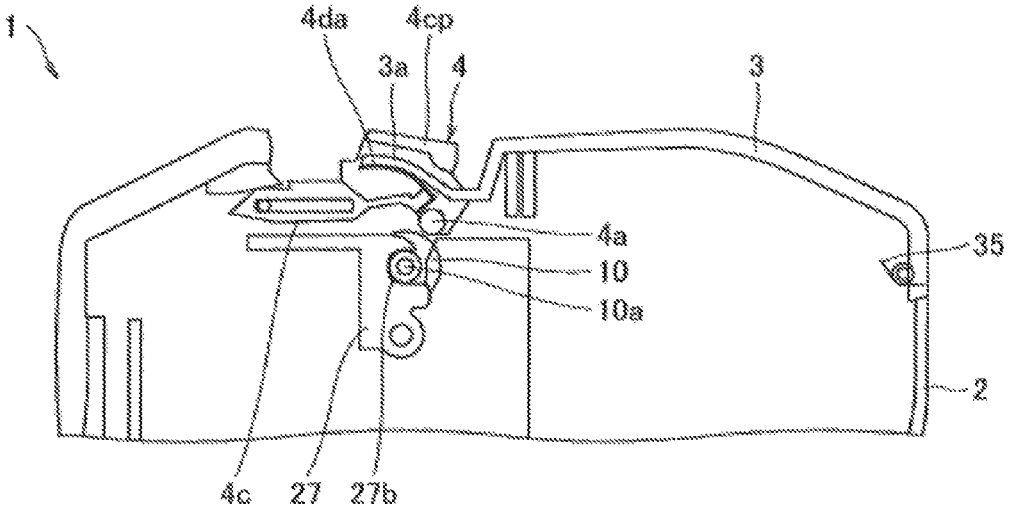
FIG. 11B schematically shows the configuration of the major part of the printer, showing the closing state of the opening and closing cover, following FIG. 10B to set the separation unit at the separation ejection position.

Next, the following describes another effect of the plate springs 4*da* of the printer 1 of the present embodiment with reference to FIGS. 10A to 11B. FIGS. 10A and 10B schematically show the configuration of the major part of the printer, showing the closing state of the opening and closing cover to set the separation unit at the separation ejection position. FIGS. 11A and 11B schematically show the configuration of the major part of the printer, showing the closing state of the opening and closing cover, following FIG. 10B to set the separation unit at the separation ejection position.

FIG. 10A shows a stage before the setting of the separation unit 4 on the separation ejection position. The separation unit 4 at the stage before setting is disposed to obliquely protrude from the upper face (the face having the ejection port) of the printer 1.

Firstly as shown in FIG. 10B, as the opening and closing cover 3 is closed, each pressing part 3*a* of the opening and closing cover 3 reaches a gap between the eave 4*cp* and the plate spring 4*da* of the separation unit 4. As the opening and closing cover 3 is further closed, as shown in FIG. 11A, each pressing part 3*a* of the opening and closing cover 3 comes into contact with the corresponding plate spring 4*da* to press down the separation unit 4, while moving smoothly toward the inner part of the gap of the separation unit 4 along the upper face of the plate spring 4*da*. That is, the plate springs 4*da* act as a guide member to close the opening and closing cover 3 smoothly as well.

Thereafter when the opening and closing cover 3 is completely closed, as shown in FIG. 11B, the platen shaft 10*a* of the platen roller 10 pivotally supported at the opening and closing cover 3 is fitted into the groove 27*b* of the head bracket 27 so as to hold the opening and closing cover 3. Further, along with this, the pressing parts 3*a* of the opening and closing cover 3 press the plate springs 4*da* so as to hold the separation unit 4 at the separation ejection position while biasing the nip roller 4*a* of the separation unit 4 toward the platen roller 10 because of the effect of the plate springs 4*da*. Herein when the opening and closing cover 3 is opened as well, the plate springs 4*da* guide the pressing parts 3*a* from the other end toward the one end (forward end) of the separation unit 4. Therefore, the opening and closing cover 3 can be opened smoothly.

In this way, in the present embodiment, the opening and closing cover 3 can be opened and closed smoothly by the plate springs 4*da*. Furthermore, the separation unit 4 can be held firmly at the separation ejection position while biasing the nip roller 4*a* of the separation unit 4 toward the platen roller 10 by the plate springs 4*da*.

(Second Embodiment)

Figure 12A:
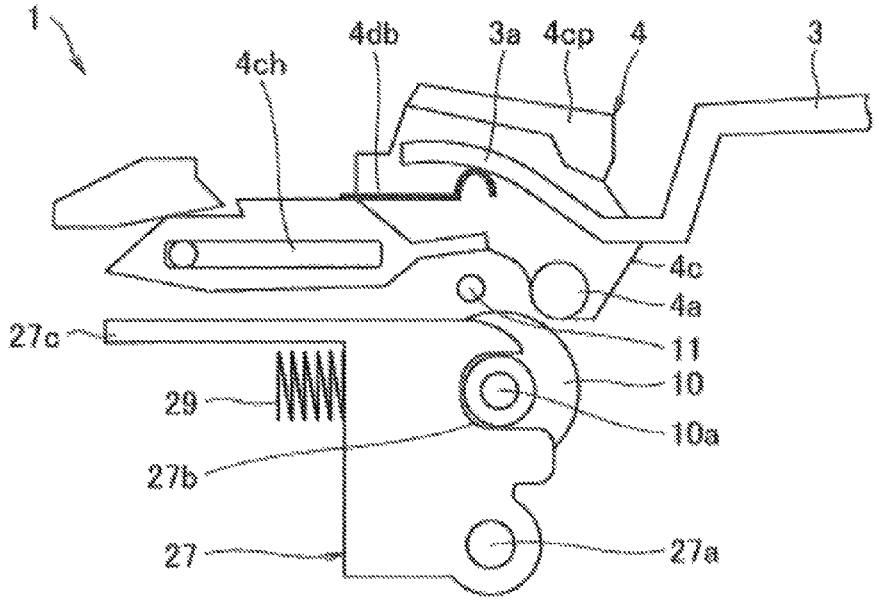
FIG. 12A is an enlarged schematic view from the lateral face showing the configuration of a major part of the inside of the printer in the separation ejection state according to the second embodiment.
Figure 12B:
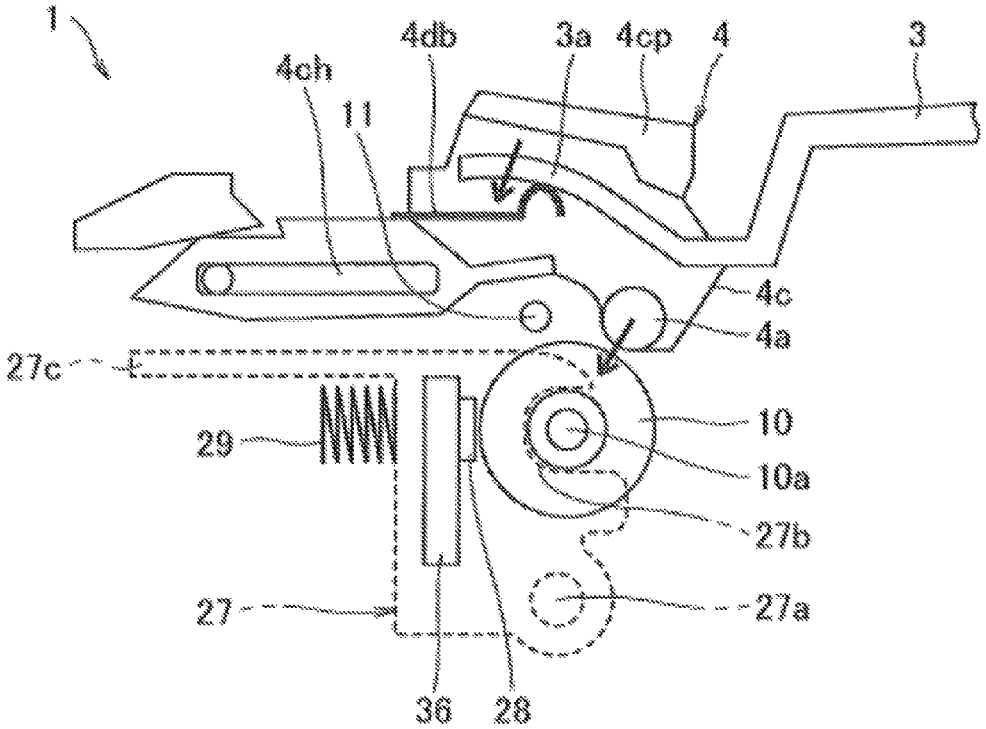
FIG. 12B is an enlarged schematic view from the lateral face showing the configuration of a major part of the inside of the printer in the separation ejection state according to the second embodiment.

FIGS. 12A and 12B are enlarged schematic views from the lateral face showing the configuration of a major part of the inside of the printer in the separation ejection state according to the second embodiment.

In the present embodiment, one end of each plate spring (one example of an elastic structure) 4*db* is fixed at a side of a guide rail hole 4*ch* of the corresponding supporting part 4*c* of a separation unit 4. Then the other end of the plate spring 4*db* floats. The front end thereof has a curved part that protrudes toward an eave 4*cp*.

Each pressing part 3*a* of the opening and closing cover 3 is set while coming into contact with the curved part of the corresponding plate spring 4*db*. Therefore, in the present embodiment, the separation unit 4 can be fixed at the separation ejection position firmly while biasing the nip roller 4*a* of the separation unit 4 toward a platen roller 10 through the effect of the plate springs 4*db*.

In this case, the plate springs 4*db* do not have a function to guide the pressing parts 3*a*, while the other configuration is the same as that of the plate springs 4*da* of the first embodiment. The configuration and the advantageous effects of the printer 1 other than the plate springs 4*db* are the same as those in the first embodiment.

(Third Embodiment)

Figure 13:
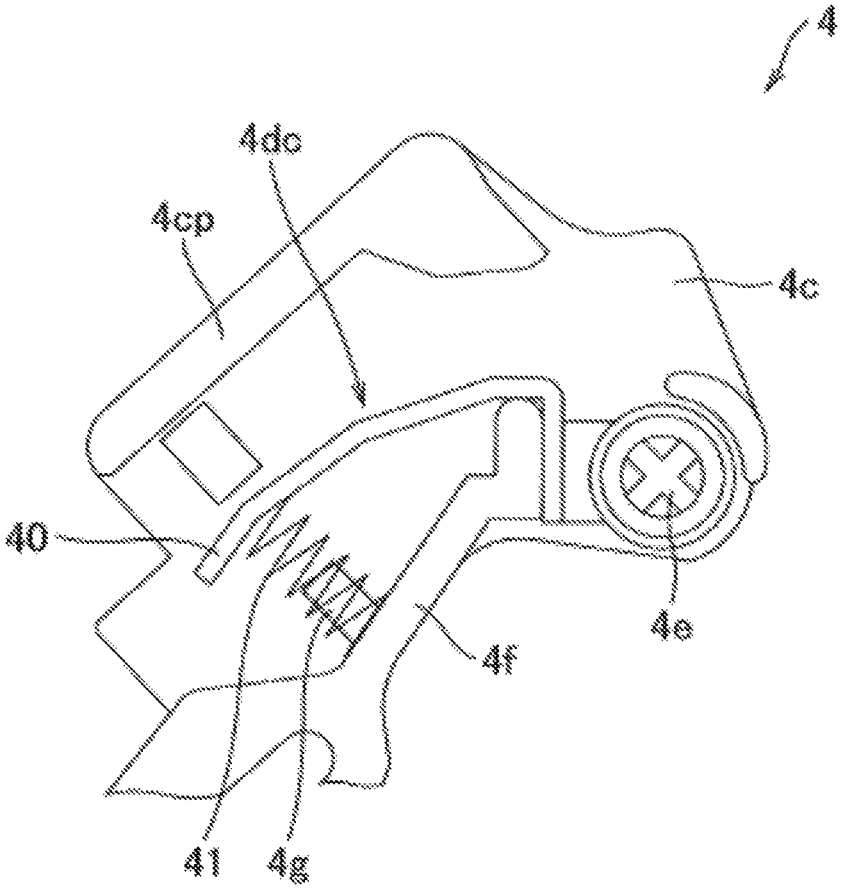
FIG. 13 is a lateral view of a major part of a separation unit included in a printer according to the third embodiment.

FIG. 13 is a lateral view of a major part of a separation unit making up a printer according to the third embodiment.

In the present embodiment, an elastic structure 4*dc* is disposed at an outer lateral face of each of a pair of supporting parts 4*c* of the separation unit 4. Although the function of this elastic structure 4*dc* is the same as that of the plate spring 4*da* as described above, the elastic structure 4*dc* includes a guide plate 40 and a coil spring 41.

Similarly to the plate spring 4*da* as described above, the guide plate 40 extends from one end to the other end of the separation unit 4. The guide plate 40 has a function to guide the corresponding pressing part 3*a* of an opening and closing cover 3. Similarly, to the plate spring 4*da*, the guide plate 40 is fixed detachably with the screw 4*e*.

Herein the guide plate 40 is made of plastic, for example. The guide plate 40 is biased toward an eave 4*cp* by the coil spring 41. Therefore, the guide plate 40 has a biasing force similar to that of the plate spring 4*da* as described above. The coil spring 41 is disposed between the guide plate 40 and a frame body 4*f* of the supporting part 4*c* so as to come into contact with both of them. The coil spring 41 is inserted on a protrusion 4*g* on the frame body 4*f* and is fixed detachably.

In the present embodiment, the pressing part 3*a* of the opening and closing cover 3 is set so as to come into contact with the guide plate 40 of the elastic structure 4*dc* of the separation unit 4. Therefore, the separation unit 4 can be fixed at the separation ejection position while biasing the nip roller 4*a* of the separation unit 4 toward a platen roller 10 through the effect of the coil spring 41 of the elastic structure 4*dc*. The configuration and the advantageous effects of the printer other than the above are the same as those in the first embodiment.

(Fourth Embodiment)

Figure 14A:
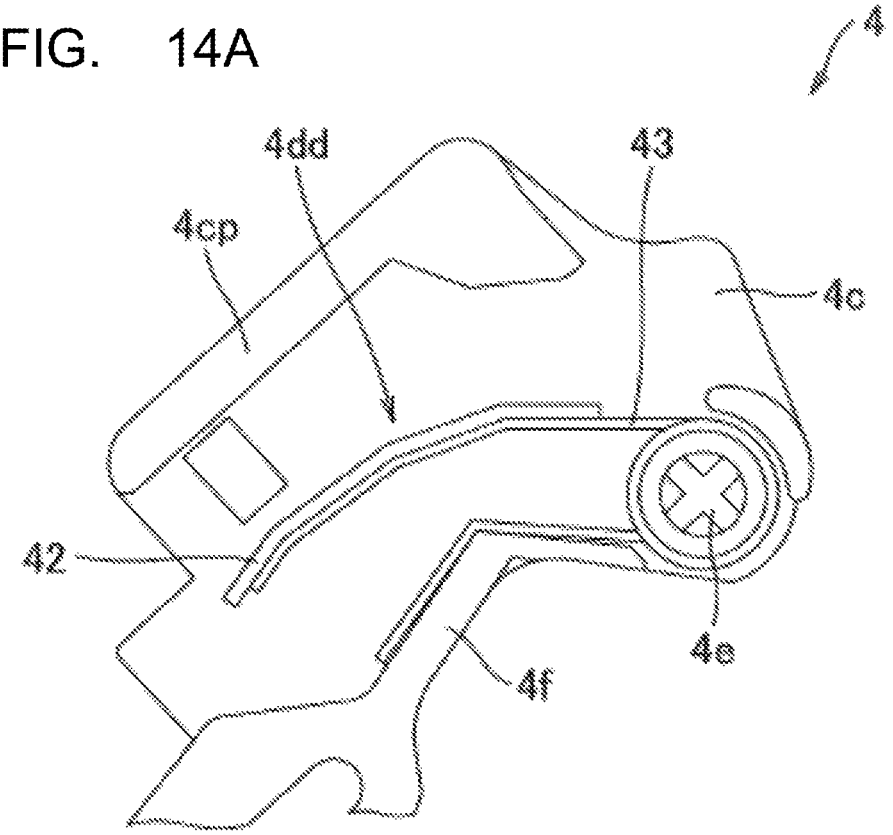
FIG. 14A is a lateral view of a major part of a separation unit included in a printer according to the fourth embodiment.
Figure 14B:
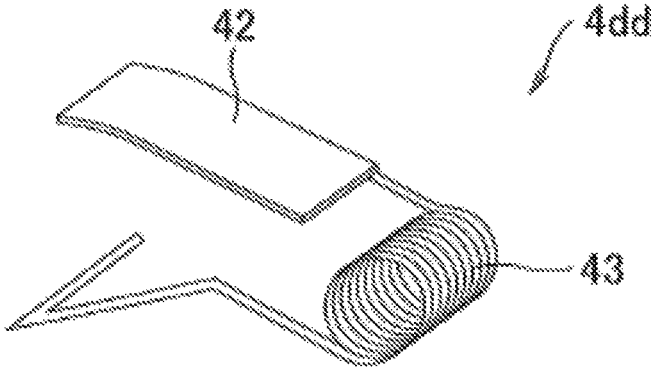
FIG. 14B is an overall perspective view of an elastic structure of FIG. 14A.

FIG. 14A is a lateral view of a major part of a separation unit making up a printer according to the fourth embodiment. FIG. 14B is an overall perspective view of an elastic structure of FIG. 14A.

In the present embodiment, an elastic structure 4*dd* is disposed at an outer lateral face of each of a pair of supporting parts 4*c* of the separation unit 4. Although the function of this elastic structure 4*dd* is the same as that of the plate spring 4*da* as described above, the elastic structure 4*dd* includes a guide plate 42 and a torsional spring 43.

Similarly to the plate spring 4*da* as described above, the guide plate 42 extends from one end to the other end of the separation unit 4. The guide plate 42 has a function to guide a pressing part 3*a*.

Herein the guide plate 42 is fixed to the torsional spring 43. This torsional spring 43 allows the guide plate 42 to act similarly to the plate spring 4*da*. The torsional spring 43 has a ring part that is inserted on the screw 4*e* and is mounted detachably.

In the present embodiment, the pressing part 3*a* of the opening and closing cover 3 is set so as to come into contact with the guide plate 42 of the elastic structure 4*dd* of the separation unit 4. Therefore, the separation unit 4 can be fixed at the separation ejection position while biasing the nip roller 4*a* of the separation unit 4 toward a platen roller 10 through the effect of the torsional spring 43 of the elastic structure 4*dd*. The configuration and the advantageous effects of the printer other than this are the same as those in the first embodiment.

The specific description of the invention by the present inventor have been provided by way of the embodiments, however, the embodiments disclosed in the specification are illustrative in all aspects and should not be limited to the disclosed techniques. That is, the technical scope of the present invention should not be construed limitedly based on the descriptions on the above embodiments, but should be construed in accordance with the definitions of the claims, and the present invention should cover all modifications thereof techniques recited in the claims and equivalent without departing from the scope of claims.

For instance, although the embodiments as described above describe a printer of a double-function type that can be used for both of the normal ejection and the separation ejection, the present invention is not limited to this. The embodiments are applicable to a printer that can be used only for the separation ejection.

Although the embodiments as described above describe the case using a continuous label including a plurality of labels temporarily adhering to a liner as a print medium, the present invention is not limited to this. For instance, a continuous label (label without liner) having one face as an adhesive face or a continuous sheet without an adhesive face as well as film which can be printed with a thermal head instead of the paper may be used as the print medium. The label without liner, the continuous sheet or the film may have position detection marks thereon. When a label without liner that exposes adhesive is fed, the feeding path may be coated with non-adhesive and roller containing silicone may be used.

The invention claimed is:

1. A printer to print on a print medium including a label temporarily adhering to a liner, comprising:

a housing;

an opening and closing cover that can be opened and closed relative to the housing;

a feed roller disposed at the opening and closing cover, the feed roller configured to feed the print medium;

a print head disposed so as to be adjacent to the feed roller when the opening and closing cover is closed, the print head configured to print on the print medium; and a separation mechanism disposed at an ejection port side of the print medium to separate the label from the liner during separation ejection of the print medium, the separation mechanism including a nip roller adjacent to the feed roller during the separation ejection, and an elastic structure configured to come into contact with the opening and closing cover during the separation ejection so as to bias the nip roller toward the feed roller.

2. The printer according to claim 1, wherein the separation mechanism is disposed so as to move between a position of the separation ejection and a position of normal ejection that is away from the position of the separation ejection.

3. The printer according to claim 2, further comprising a pair of pressing parts disposed at one end side of the opening and closing cover, the pair of pressing parts configured to close the opening and closing cover so as to press against the separation mechanism during the separation ejection.

4. The printer according to claim 3, wherein when the opening and closing cover is closed during the separation ejection, the elastic structure comes into contact with the pair of pressing parts of the opening and closing cover so as to guide the opening and closing cover to the position of the separation ejection, and when the separation mechanism reaches the position of the separation ejection, the elastic structure biases the nip roller toward the feed roller.

5. The printer according to claim 2, wherein the separation mechanism includes a pair of supporting parts, and the elastic structure extends from one end side to the other end side of the pair of supporting parts so as to guide the opening and closing cover during closing of the opening and closing cover.

6. The printer according to claim 2, wherein the elastic structure is disposed detachably.

7. The printer according to claim 2, wherein the elastic structure includes a plate spring.

8. The printer according to claim 1, further comprising a pair of pressing parts disposed at one end side of the opening and closing cover, the pair of pressing parts configured to close the opening and closing cover so as to press against the separation mechanism during the separation ejection.

9. The printer according to claim 8, wherein when the opening and closing cover is closed during the separation ejection, the elastic structure comes into contact with the pair of pressing parts of the opening and closing cover so as to guide the opening and closing cover to a position of the separation ejection, and when the separation mechanism reaches the position of the separation ejection, the elastic structure biases the nip roller toward the feed roller.

10. The printer according to claim 9, wherein the separation mechanism includes a pair of supporting parts, and the elastic structure extends from one end side to the other end side of the pair of supporting parts so as to guide the opening and closing cover during closing of the opening and closing cover.

11. The printer according to claim 9, wherein the elastic structure is disposed detachably.

12. The printer according to claim 9, wherein the elastic structure includes a plate spring.

13. The printer according to claim 8, wherein the separation mechanism includes a pair of supporting parts, and the elastic structure extends from one end side to the other end side of the pair of supporting parts so as to guide the opening and closing cover during closing of the opening and closing cover.

14. The printer according to claim 8, wherein the elastic structure is disposed detachably.

15. The printer according to claim 8, wherein the elastic structure includes a plate spring.

16. The printer according to claim 1, wherein the separation mechanism includes a pair of supporting parts, and the elastic structure extends from one end side to the other end side of the pair of supporting parts so as to guide the opening and closing cover during closing of the opening and closing cover.

17. The printer according to claim 16, wherein the elastic structure is disposed detachably.

18. The printer according to claim 16, wherein the elastic structure includes a plate spring.

19. The printer according to claim 1, wherein the elastic structure is disposed detachably.

20. The printer according to claim 1, wherein the elastic structure includes a plate spring.

* * * * *